US010468240B2

(12) United States Patent
Takahashi

(10) Patent No.: US 10,468,240 B2
(45) Date of Patent: Nov. 5, 2019

(54) GLOW DISCHARGE SYSTEM AND GLOW DISCHARGE MASS SPECTROSCOPE USING THE SAME

(71) Applicant: Glow Technology KK, Tokyo (JP)

(72) Inventor: Takahiro Takahashi, Tokyo (JP)

(73) Assignee: GLOW TECHNOLOGY KK, Tokyo (JP)

( * ) Notice: Subject to any disclaimer, the term of this patent is extended or adjusted under 35 U.S.C. 154(b) by 0 days.

(21) Appl. No.: 16/104,765

(22) Filed: Aug. 17, 2018

(65) Prior Publication Data

US 2019/0304767 A1 Oct. 3, 2019

(30) Foreign Application Priority Data

Apr. 3, 2018 (JP) ..... 2018-71272

(51) Int. Cl.
*H01J 49/10* (2006.01)
*H01J 49/06* (2006.01)
*H01J 49/04* (2006.01)

(52) U.S. Cl.
CPC ..... *H01J 49/10* (2013.01); *H01J 49/0459* (2013.01); *H01J 49/067* (2013.01)

(58) Field of Classification Search
CPC ..... H01J 49/10; H01J 49/14; H01J 49/142; H01J 49/147; H01J 49/0459; H01J 49/0463; H01J 49/0418; H01J 49/067
See application file for complete search history.

(56) References Cited

U.S. PATENT DOCUMENTS 3,708,418 A * 1/1973 Quinn ..... H01J 37/32009 204/192.34
4,367,427 A * 1/1983 Grimm ..... H01J 17/44 313/162

(Continued)

FOREIGN PATENT DOCUMENTS

DE 19518374 A1 11/1996
JP 61-179652 U 11/1986

(Continued)

OTHER PUBLICATIONS

Japanese Decision of Patent (including an English translation thereof) issued in the corresponding Japanese Patent Application No. 2018-071272 dated Jul. 31, 2018.

(Continued)

*Primary Examiner* — Nicole M Ippolito
*Assistant Examiner* — Sean M Luck
(74) *Attorney, Agent, or Firm* — Birch, Stewart, Kolasch & Birch, LLP

(57) ABSTRACT

There is provided a glow discharge mass spectroscope having a higher analytical sensitivity by increasing an amount of extracted ion beams without a significant change in device construction and drive conditions of conventional glow discharge systems. When glow discharge is generated in a discharge region 27, an amount of ion beams extracted by a magnetic field formed by a first magnet 15 and a second magnet 26 is increased by disposing the circular and flat plate-shaped first magnet 15 between a flat plate-shaped solid sample 30 and a plunger 16 for holding the solid sample 30, disposing the ring-shaped second magnet 26 disposed coaxially with the first magnet 15 so as to surround a discharge region 27 at an ion extraction port side of a cell body 21 that forms the discharge region 27, and disposing the first magnet 15 and the second magnet 26 so that magnetization directions are parallel to each other in a (Continued)

direction toward the ion extraction port from the opening and magnetic poles are opposite to each other.

12 Claims, 4 Drawing Sheets

(56) References Cited

U.S. PATENT DOCUMENTS 4,393,333 A * 7/1983 Sakudo ..... H01J 37/08 250/396 ML
4,673,480 A * 6/1987 Lamont, Jr. ..... H01J 37/3405 204/192.12
4,735,699 A * 4/1988 Wort ..... C23C 14/0635 204/192.15
4,901,669 A * 2/1990 Yamamoto ..... C23C 16/517 118/723 ER
4,912,324 A 3/1990 Clark et al.
4,946,576 A * 8/1990 Dietrich ..... C23C 14/0047 204/192.12
5,015,493 A * 5/1991 Gruen ..... C23C 14/32 204/298.05
5,032,205 A * 7/1991 Hershkowitz ..... H01J 37/32623 156/345.46
5,174,875 A * 12/1992 Hurwitt ..... C23C 14/345 204/192.12
5,184,016 A 2/1993 Ronan et al.
5,221,427 A * 6/1993 Koinuma ..... B29C 59/14 156/345.46
5,374,327 A * 12/1994 Imahashi ..... G01N 21/68 216/60
5,548,183 A * 8/1996 Miyoshi ..... H01J 37/065 313/153
5,675,606 A * 10/1997 Brainard ..... H01J 27/14 315/111.71
5,733,820 A * 3/1998 Adachi ..... G01N 21/68 216/59
5,818,170 A * 10/1998 Kikunaga ..... H01J 23/075 315/5
5,988,103 A * 11/1999 Fetherston ..... C23C 14/046 118/723 E
6,137,231 A * 10/2000 Anders ..... H01J 37/32027 118/723 E
6,876,155 B2 * 4/2005 Howald ..... H01J 37/321
8,933,397 B1 * 1/2015 Hanson ..... H01J 49/42 250/287
9,466,453 B2 * 10/2016 Dinu-Gurtler ..... G03F 7/70058
9,711,318 B2 * 7/2017 White ..... H01J 27/14
9,721,777 B1 * 8/2017 Muntean ..... H01J 49/34
2001/0010255 A1 * 8/2001 Kijima ..... G01N 21/68 156/345.25
2002/0003210 A1 * 1/2002 Marcus ..... G01N 21/67 250/288
2007/0166599 A1 * 7/2007 Burtner ..... H01J 27/022 250/423 R
2010/0075510 A1 * 3/2010 Jan ..... C23C 16/405 438/785
2011/0291567 A1 * 12/2011 Ganciu-Petcu ..... G01N 21/67 315/111.41
2014/0224996 A1 * 8/2014 Case ..... H01J 35/14 250/396 ML
2014/0284470 A1 * 9/2014 Choi ..... H01J 49/0054 250/282
2015/0137682 A1 * 5/2015 Lacoste ..... H01J 61/327 315/111.41
2016/0172146 A1 * 6/2016 Wang ..... H01J 49/147 250/282
2017/0309459 A1 10/2017 Tsukamoto et al.

FOREIGN PATENT DOCUMENTS

JP 1-189847 A 7/1989
JP 6-310089 A 11/1994
JP 2014-190756 A 10/2014
JP 2016-41842 A 3/2016
JP 2017-220360 A 12/2017
WO WO 96/37905 A1 11/1996
WO WO 2016/096457 A1 6/2016

OTHER PUBLICATIONS

Japanese Notification of Reasons for Refusal (including an English translation thereof) issued in the corresponding Japanese Patent Application No. 2018-071272 dated May 22, 2018.
Extended European Search Report for European Application No. 18189896.6, dated Mar. 11, 2019.
Gavrilov et al., "Glow-discharge-driven bucket ion source," Rev. Sci. Instrum., vol. 75. No. 5, May 17, 2004, pp. 1875-1877.

* cited by examiner

[Fig. 1]
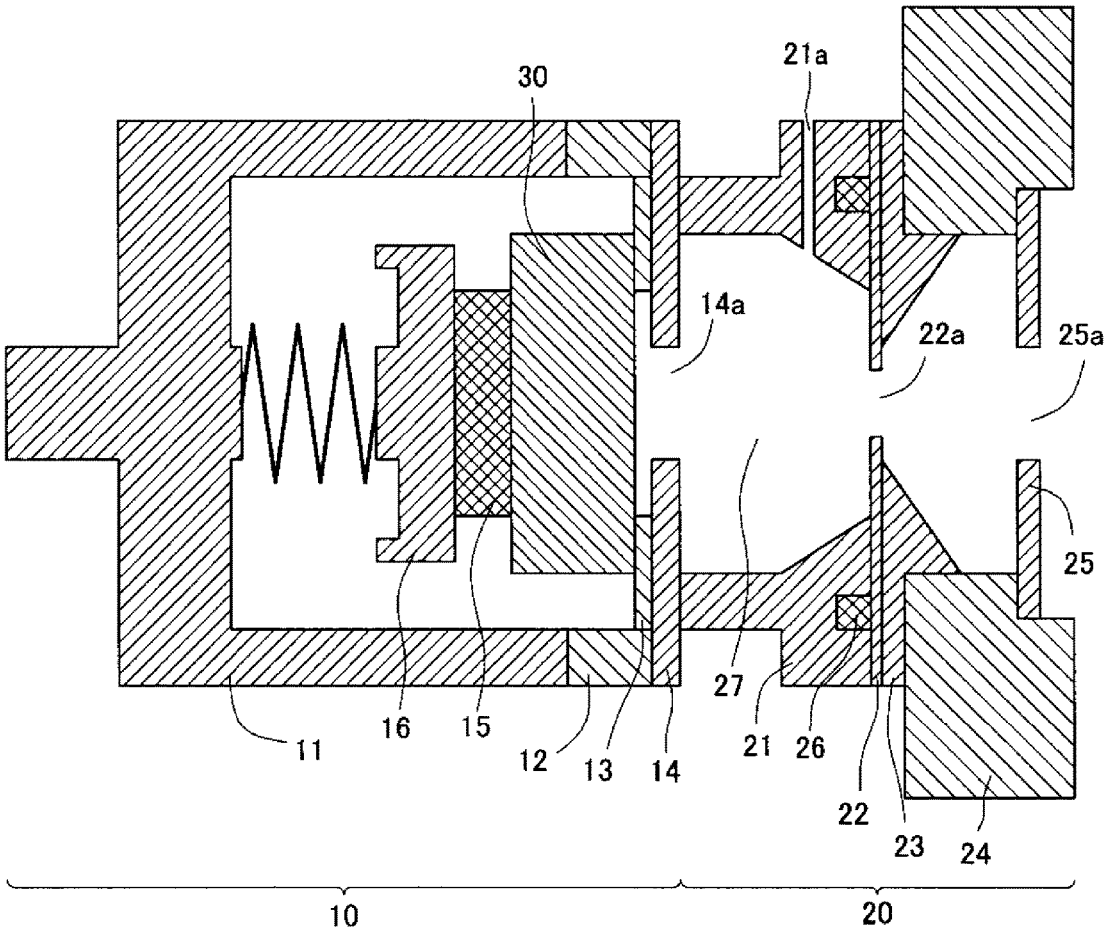

[Fig 2]
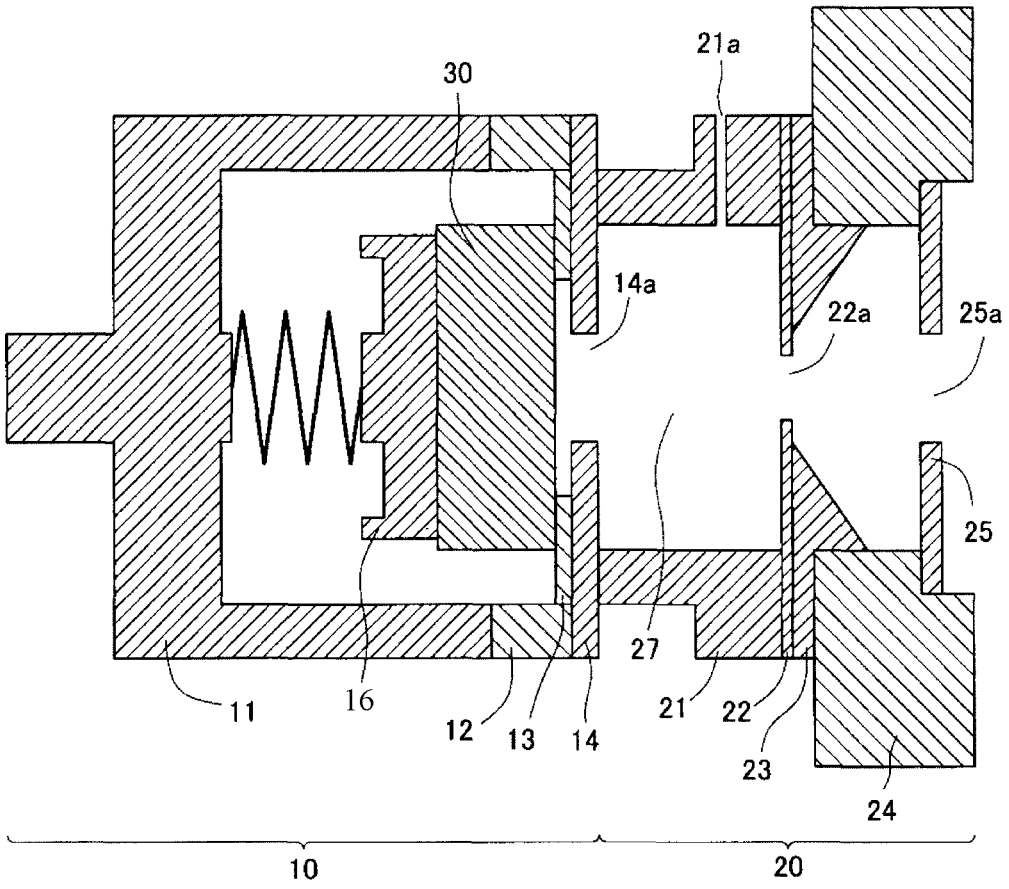

[Fig. 3]
PEAK STABILITY
| | | | | | |
|---|---|---|---|---|---|
| Mass | 64.905 | | Number of Scans | 2 | |
| DAC Step | 2 | | Number of Points | 200 | Per Scan |
| Delay | 1 | Seconds | Collector | Faraday | |
| Daly Int. Time | 100 | ms | Faraday Int. Time | 20 | ms |
| F.S.D | 1.6E-9 | Amps | Time Taken | 0 :0 :32 | |
| SCAN | CENTRE MASS | MAX INTENSITY | PEAK AREA | 50% RES | 5% RES |
|---|---|---|---|---|---|
| 1 | 64.9043 | 1.3E-9 | 1.7E-8 | 8399 | 4410 |
| 2 | 64.9056 | 1.4E-9 | 1.0E-7 | 1560 | 1327 |
| 0 | 0.0000 | 0.0E+0 | 0.0E+0 | 0 | 0 |
| %RSD | 0.002 | 6.77 | 100.51 | 97.35 | 75.98 |
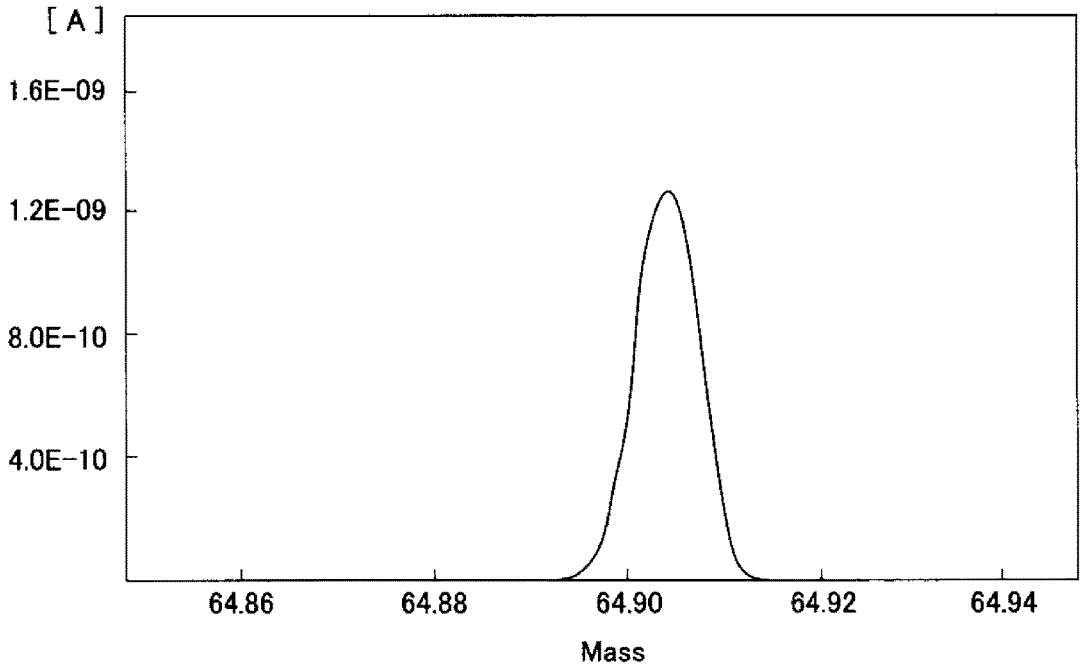

[Fig. 4]
PEAK STABILITY
| | | | | | |
|---|---|---|---|---|---|
| Mass | 62.928 | | Number of Scans | 2 | |
| DAC Step | 2 | | Number of Points | 200 | Per Scan |
| Delay | 1 | Seconds | Collector | Faraday | |
| Daly Int. Time | 100 | ms | Faraday Int. Time | 20 | ms |
| F.S.D | 1.2E-9 | Amps | Time Taken | 0 :0 :32 | |
| SCAN | CENTRE MASS | MAX INTENSITY | PEAK AREA | 50% RES | 5% RES |
|---|---|---|---|---|---|
| 1 | 62.9303 | 1.0E-9 | 1.3E-8 | 8585 | 4611 |
| 2 | 62.9318 | 1.1E-9 | 8.0E-8 | 1552 | 1348 |
| 0 | 0.0000 | 0.0E+0 | 0.0E+0 | 0 | 0 |
| %RSD | 0.002 | 6.61 | 102.96 | 98.12 | 77.45 |
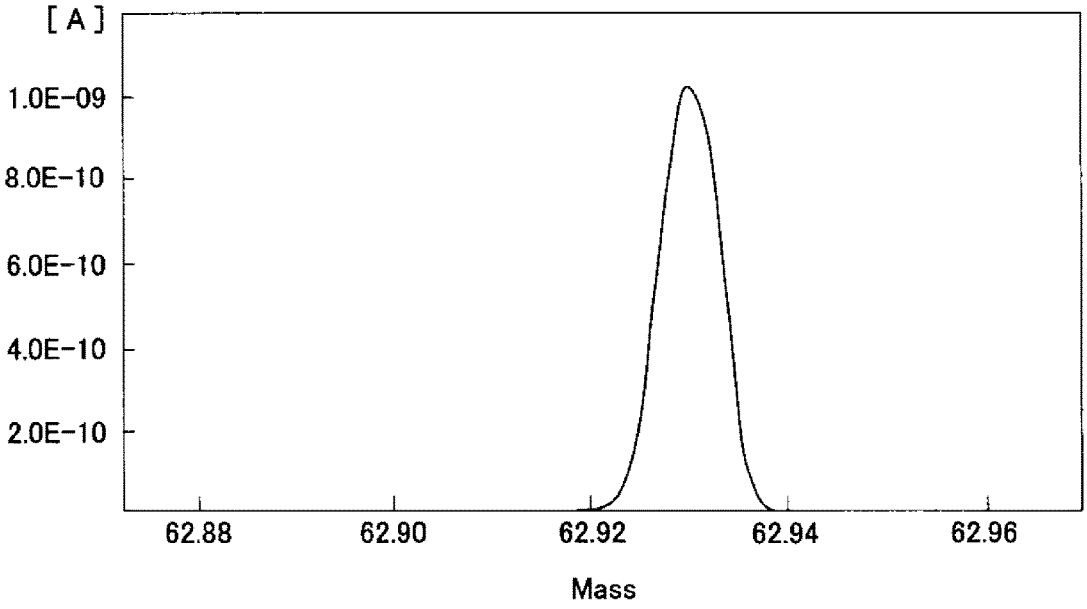

GLOW DISCHARGE SYSTEM AND GLOW DISCHARGE MASS SPECTROSCOPE USING THE SAME

TECHNICAL FIELD

The present invention relates to a flat cell-type glow discharge system and a glow discharge mass spectroscope using the same.

BACKGROUND ART

A glow discharge mass spectroscope (GDMS) is known as an analyzer for various solid samples such as metals, semiconductors, and insulating materials. Such analyzer is a device that sputters a surface of a solid sample utilizing glow discharge and measures ionized constituent atoms of the solid sample with a mass spectrometer.

The analyzer has a glow discharge system in which, as disclosed in Patent Literature 1, a solid sample is placed so that a surface of the solid sample is exposed within a discharge cell, an inert gas is introduced into the discharge cell to generate glow discharge by which the solid sample is sputtered, and discharged atoms are ionized within the discharge cell, followed by extraction of ionized atoms as ion beams through an opening formed in the discharge cell.

PRIOR ART REFERENCE

Patent Literature

Patent Literature 1: Japanese Patent Application Laid-open No. 2017-220360 A

SUMMARY OF THE INVENTION

Problem to be Solved by the Invention

In a glow discharge mass spectroscope, what is desired for an enhancement in analytical sensitivity is to increase a beam (ion) amount of ion beams extracted from the glow discharge system.

An object of the present invention is to provide a glow discharge mass spectroscope having a higher analytical sensitivity by increasing an amount of extracted ion beams without a significant change in device construction and drive conditions of a conventional glow discharge system.

Means for Solving the Problem

According to a first aspect of the present invention, there is provided a glow discharge system used for a glow discharge mass spectroscope, the glow discharge system including:

a sample holder that has an opening, and includes a holding member holding a flat plate-shaped solid sample with a main surface facing the opening, from a side opposite to the opening;

a discharge cell that is adjacent to the opening side of the sample holder, has an ion extraction port positioned at a side opposite to the opening, and forms a discharge region, wherein a circular and flat plate-shaped first magnet is provided on a side where the holding member holds the solid sample;

a ring-shaped second magnet that is embedded in the discharge cell so as to surround the discharge region and is disposed coaxially with the first magnet is provided on a side of the ion extraction port of the discharge region; and the first and second magnets are disposed so that magnetization directions are parallel to each other in a direction toward the ion extraction port from the opening and magnetic poles are opposite to each other.

The glow discharge system according to the present invention includes the following construction as a preferred embodiment.

The holding member is a plunger made of a magnetic stainless steel.

The discharge cell has an extraction electrode at a side opposite to the opening of the ion extraction port.

According to a second aspect of the present invention, there is provided a glow discharge mass spectroscope comprising:

a glow discharge system that extracts ion beams of constituent atoms of a solid sample from the solid sample by glow discharge; and a mass spectrograph that performs a mass spectroscopic analysis of ions contained in the ion beams, wherein the glow discharge system is the glow discharge system according to the above present invention.

The glow discharge mass spectroscope of the present invention includes a preferred embodiment wherein a magnetic field system that separates and selects target ions from the ion beams extracted from the glow discharge system, and an electric field system that focuses energy of ion beams selected in the magnetic field system are further provided.

Effects of the Invention

The glow discharge system of the present invention can extract ion beams in an amount that has been significantly increased compared with the conventional glow discharge systems by disposing a magnet on each of a back surface of a solid sample and an ion extraction port side of a discharge cell. Thus, according to the present invention, an amount of ion beams to be analyzed in a mass spectrograph can be increased by slightly modifying an apparatus construction, thereby realizing a higher sensitivity in mass spectroscopic analysis of the solid sample than the prior art.

BRIEF DESCRIPTION OF THE DRAWINGS

FIG. 1 is an end view that schematically illustrates a construction of an embodiment of the glow discharge system of the present invention and that is a cross section including a central axis of ion beams extracted from the glow discharge system.

FIG. 2 is an end view that schematically illustrates a construction of a conventional glow discharge system and that is a cross section including a central axis of ion beams extracted from the glow discharge system.

FIG. 3 is a graph illustrating an analysis chart of a mass spectroscopic analysis for copper using a glow discharge system of the present invention.

FIG. 4 is a graph illustrating an analysis chart of a mass spectroscopic analysis for copper using a conventional glow discharge system.

MODE FOR CARRYING OUT THE INVENTION

Although, for the present invention, embodiments will be described in more detail appropriately with reference to the drawings, the present invention should not be construed to be limited by the following embodiments. Well-known or publicly known techniques in the technical field can be applied to portions not specifically described in the following description and portions not specifically illustrated in the drawings.

The glow discharge system of the present invention is characterized in that a beam amount of ion beams extracted from the glow discharge system is significantly increased by disposing a magnet on a back surface of a solid sample and an ion extraction port side of a discharge cell so that the directions of the magnetic poles are opposite to each other.

At the outset, a conventional glow discharge system is illustrated in FIG. 2. FIG. 2 is an end view that schematically illustrates a construction of a conventional glow discharge system and that is a cross section including a central axis of ion beams extracted from the glow discharge system.

The glow discharge system illustrated in FIG. 2 is a flat cell-type glow discharge system using a flat plate-shaped solid sample 30 and including a sample holder 10 that holds a solid sample 30, and a discharge cell 20 that generates glow discharge to extract ion beams (not illustrated) from the solid sample 30.

The sample holder 10 includes a front plate 14 that has an opening 14*a* and that is disposed on a frame 11 with an insulating ring 12 provided between the frame 11 and the front plate 14, and a solid sample 30 is held by being pressed against a sample isolator 13 by a plunger 16 that is a holding member with one main surface of the solid sample 30 facing the opening 14*a*. A part of the main surface of the solid sample 30 is exposed within the opening 14*a*. The frame 11 and the plunger 16 are formed of an electroconductive material, for example, aluminum, the insulating ring 12 is formed of an insulating material, for example, polyether ether ketone (PEEK), the sample isolator 13 is a plate that has an opening in communication with the opening 14*a*, that is formed of an insulating material, for example, alumina, and the front plate 14 is formed of an electroconductive material, for example, tantalum.

The discharge cell 20 includes a cell body 21 that is cylindrical with one of openings being adjacent to an opening 14*a* side of a front plate 14 that is an opening of a sample holder 10, in contact with the front plat 14, while the other opening side is an ion extraction port side. The cell body 21 has a discharge region 27 in its interior and has a gas introduction hole 21*a* for introducing a discharge gas at a side wall. In the other opening of the cell body 21, a slit plate 22, an end plate 23, a cell mounting plate 24, and an extraction plate 25 are disposed in that order and each have an opening for extraction of ions to the outside. In the drawing, 22*a* denotes a slit formed in the slit plate 22 and is an ion extraction portion from the discharge region 27. The discharge region 27 is a closed system except for the gas introduction hole 21*a* and the slit 22*a*. All of the cell body 21, the slit plate 22, and the end plate 23 are formed of an electroconductive material, for example, tantalum, and the cell mounting plate 24 is formed of an insulating material, for example, an insulating resin such as PEEK.

In the construction, an inert gas, for example, a high-purity argon gas (purity: 99.9999% or higher), is introduced through the gas introduction hole 21*a* into the discharge region 27, and a predetermined voltage is applied by using the solid sample 30 as a negative electrode through the frame 11 and the plunger 16, and using the slit plate 22, the front plate 14, and the end plate 23 as an positive electrode. Further, the extraction plate 25 functions as an extraction electrode for extraction of ions from the discharge region 27 and sets a potential in a range of minus several tens of volts to minus 1000 volts to the cell body 21. In the discharge region 27, glow discharge is generated, ions of a discharge gas sputter a surface of the solid sample 30, emitted constituent atoms of the solid sample 30 are ionized by plasma in the discharge region 27, and ionized atoms are passed through a slit 22*a* and an opening 25*a* and are extracted as ion beams.

The ion beams extracted from the glow discharge system are subjected to separation and selection of ions for analysis purposes in a magnetic field system not illustrated, the selected ion beams are subjected to beam energy focusing in an electric field system not illustrated, and a mass spectroscopic analysis for ions contained in the ion beams is performed in a mass spectrograph not illustrated to determine a composition of the solid sample 30. Double-focusing mass spectrometers are preferred as the mass spectrograph.

Next, the glow discharge system of the present invention will be described with reference to FIG. 1. FIG. 1 is an end view that schematically illustrates a construction of an embodiment of a glow discharge system and that is a cross section including a central axis of ion beams extracted from the glow discharge system.

The glow discharge system of the present invention has the same basic construction as the conventional glow discharge system, except that a first magnet and a second magnet as will described later have been added. Thus, only portions different from the conventional glow discharge system will be described, and portions that are the same as the conventional glow discharge system will be omitted.

In the present invention, a first magnet 15 is disposed on a surface on a solid sample 30 side of a plunger 16 that is a holding member, and, for fixing the magnet 15, the plunger 16 is formed of a magnetic electric conductor, for example, a magnetic stainless steel. Further, a groove is formed on an ion extraction port side of the cell body 21, and a second magnet 26 is embedded in the groove. As described above, a slit plate 22 is disposed on an ion extraction port side of the cell body 21, and this prevents the magnet 26 from being exposed to the discharge region 27 and the outside.

The first magnet 15 disposed in the sample holder 10 and the second magnet 26 disposed in the discharge cell 20 are disposed so that the magnetization directions are in parallel to a direction from an opening 14*a* toward an ion extraction port, that is, an opening 25*a* (a horizontal direction in a paper surface), and that the magnetic poles are opposite to each other. Thus, in FIG. 1, the first magnet 15 and the second magnet 26 are disposed so that N poles or S poles face each other.

In the present invention, the disposition of the first magnet 15 and the second magnet 26 as described above leads to generation of a magnetic field having a strain by the same poles themselves in the discharge region 27 in the discharge cell 20. As a result, a beam amount of ion beams extracted from the discharge region 27 is increased, and an ion amount measured in a mass spectrograph is increased, contributing to an improvement in analytical sensitivity.

In the glow discharge system illustrated in FIG. 1, both the first magnet 15 and the solid sample 30 are a circular flat plate, the cell body 21 is a cylindrical, and the opening 14*a* and the opening 25*a* are circular. Further, the slit 22*a* is in a linear form perpendicular to a paper surface. The second magnet 26 is in a ring form that surrounds the discharge region 27 and that is disposed coaxially with the first magnet 15.

In the glow discharge system illustrated in FIG. 2, the inner diameter of the cell body 21 is uniform, while, in the glow discharge system illustrated in FIG. 1, the inner diameter of the ion extraction port side in the cell body 21 is gradually decreased to form a taper. This is a change in structure in order to increase the thickness of the wall surface and thus to prevent lowering of strength due to embedding of the second magnet.

In the present invention, an electric conductor or a semiconductor material can be directly analyzed as a solid sample 30. Further, for the insulator, electric conductors such as gold, graphite, and silver can be mixed as a binder with an insulator and molded into a solid sample 30, followed by analysis of the solid sample 30. Further, even solid flat plate-shaped insulators can be analyzed by using an auxiliary electrode (not illustrated) as a negative electrode to generate glow discharge.

Examples

A glow discharge system in a glow discharge mass spectroscope "model VG90004Mk4" manufactured by Thermo Elemental limited was replaced with a glow discharge system of the present invention illustrated in FIG. 1, and a mass spectroscopic analysis of a solid sample of copper was performed. Further, the copper solid sample as used above was subjected to a mass spectroscopic analysis under the same conditions as described above, except that a conventional glow discharge system illustrated in FIG. 2 was used in the glow discharge mass spectroscope.

Copper contains Cu63 and Cu65 that are isotopes, at a mass ratio of Cu63:Cu65=7:3. For this reason, Cu63 having a high content has hitherto been measured for copper measurement. Also in this Example, a peak of Cu63 had a height of $1.0\times10^{-9}$A in a mass spectroscopic analysis using the conventional glow discharge system.

On the other hand, in a mass spectroscopic analysis using a glow discharge system of the present invention, due to an excessively high peak as a result of Cu63 measurement, Cu65 having a low content was measured for detector protection purposes. As a result, the peak had a height of $1.3\times10^{-9}$A that was $3.0\times10^{-9}$A in terms of Cu63. This height was three times the peak height of Cu63 measured using the conventional glow discharge system. Analysis charts for the obtained Cu65 and Cu63 are illustrated in FIGS. 3 and 4.

REFERENCE SIGNS LIST

10 Sample holder
11 Frame
12 Insulating ring
13 Sample isolator
14 Front plate
14*a* Opening
15 First magnet
16 Plunger
20 Discharge cell
21 Cell body
21*a* Gas introduction hole
22 Slit plate
22*a* Slit
23 End plate
24 Cell mounting plate
25 Extraction plate
25*a* Opening
26 Second magnet
27 Discharge region
30 Solid sample

The invention claimed is:

1. A glow discharge system used for a glow discharge mass spectroscope, the glow discharge system comprising:

a sample holder that has an opening, and includes a holding member holding a flat plate-shaped solid sample with a main surface facing the opening, from a side opposite to the opening; and a discharge cell that is adjacent to the opening side of the sample holder, and has an ion extraction port positioned at a side opposite to the opening, and forms a discharge region, wherein a circular and flat plate-shaped first magnet is provided on a side where the holding member holds the solid sample;

a ring-shaped second magnet that is embedded in the discharge cell so as to surround the discharge region and is disposed coaxially with the first magnet is provided on a side of the ion extraction port of the discharge region; and the first and second magnets are disposed so that magnetization directions are parallel to each other in a direction toward the ion extraction port from the opening and magnetic poles of the first and second magnets repel each other.

2. The glow discharge system according to claim 1, wherein the holding member is a plunger made of a magnetic stainless steel.

3. The glow discharge system according to claim 1, further comprising an extraction electrode, wherein the extraction electrode is disposed so that the extraction electrode is adjacent to the opening of the ion extraction port and located at a side opposite to the opening of the sample holder.

4. The glow discharge system according to claim 2, further comprising an extraction electrode, wherein the extraction electrode is disposed so that the extraction electrode is adjacent to the opening of the ion extraction port and located at a side opposite to the opening of the sample holder.

5. A glow discharge mass spectroscope comprising:

a glow discharge system that extracts ion beams of constituent atoms of a solid sample from the solid sample by glow discharge; and a mass spectrograph that performs a mass spectroscopic analysis for ions contained in the ion beams, wherein the glow discharge system is the glow discharge system according to claim 1.

6. A glow discharge mass spectroscope comprising:

a glow discharge system that extracts ion beams of constituent atoms of a solid sample from the solid sample by glow discharge; and a mass spectrograph that performs a mass spectroscopic analysis for ions contained in the ion beams, wherein the glow discharge system is the glow discharge system according to claim 2.

7. A glow discharge mass spectroscope comprising:

a glow discharge system that extracts ion beams of constituent atoms of a solid sample from the solid sample by glow discharge; and a mass spectrograph that performs a mass spectroscopic analysis for ions contained in the ion beams, wherein the glow discharge system is the glow discharge system according to claim 3.

8. A glow discharge mass spectroscope comprising:

a glow discharge system that extracts ion beams of constituent atoms of a solid sample from the solid sample by glow discharge; and a mass spectrograph that performs a mass spectroscopic analysis for ions contained in the ion beams, wherein the glow discharge system is the glow discharge system according to claim 4.

9. The glow discharge mass spectroscope according to claim 5, further comprising:

a magnetic field system that separates and selects target ions from the ion beams extracted from the glow discharge system; and an electric field system that focuses energy of ion beams selected in the magnetic field system.

10. The glow discharge mass spectroscope according to claim 6, further comprising:

a magnetic field system that separates and selects target ions from the ion beams extracted from the glow discharge system; and an electric field system that focuses energy of ion beams selected in the magnetic field system.

11. The glow discharge mass spectroscope according to claim 7, further comprising:

a magnetic field system that separates and selects target ions from the ion beams extracted from the glow discharge system; and an electric field system that focuses energy of ion beams selected in the magnetic field system.

12. The glow discharge mass spectroscope according to claim 8, further comprising:

a magnetic field system that separates and selects target ions from the ion beams extracted from the glow discharge system; and an electric field system that focuses energy of ion beams selected in the magnetic field system.

* * * * *